US006966373B2

(12) United States Patent
Von Gynz-Rekowski

(10) Patent No.: US 6,966,373 B2
(45) Date of Patent: Nov. 22, 2005

(54) INFLATABLE SEALING ASSEMBLY AND METHOD FOR SEALING OFF AN INSIDE OF A FLOW CARRIER

(75) Inventor: Gunther Von Gynz-Rekowski, Montgomery, TX (US)

(73) Assignee: Ashmin LC, Montgomery, TX (US)

( * ) Notice: Subject to any disclaimer, the term of this patent is extended or adjusted under 35 U.S.C. 154(b) by 0 days.

(21) Appl. No.: 10/789,151

(22) Filed: Feb. 27, 2004

(65) Prior Publication Data

US 2005/0189119 A1 Sep. 1, 2005

(51) Int. Cl.[7] ..... E21B 34/06

(52) U.S. Cl. ..... 166/250.01; 166/53; 166/66; 166/187; 166/192; 166/387; 138/93; 251/5

(58) Field of Search ..... 166/250.01, 387, 166/192, 53, 66, 187; 175/38, 317, 318, 324; 138/93; 137/844, 853; 251/1.1, 1.2, 1.3, 251/5

(56) References Cited

U.S. PATENT DOCUMENTS

| | | | | |
|---|---|---|---|---|
| 1,709,949 A | | 4/1929 | Rasmussen et al. | |
| 1,861,726 A | * | 6/1932 | Trout | 277/324 |
| 2,798,561 A | | 7/1957 | True | |
| 3,367,422 A | * | 2/1968 | Sims | 166/187 |
| 3,494,588 A | * | 2/1970 | Kisling | 251/5 |
| 3,589,667 A | | 6/1971 | Lewis et al. | |
| 3,717,203 A | | 2/1973 | Kirkpatrick et al. | |
| 3,744,562 A | | 7/1973 | Priebe et al. | |
| 3,746,097 A | | 7/1973 | Mott | |
| 3,817,327 A | | 6/1974 | Grable et al. | |
| 3,853,177 A | | 12/1974 | Mott | |
| 3,884,261 A | * | 5/1975 | Clynch | 137/488 |
| 4,345,735 A | * | 8/1982 | Regan | 251/1.2 |
| 4,377,206 A | | 3/1983 | Chambers | |
| 4,440,232 A | | 4/1984 | LeMoine | |
| 4,492,359 A | | 1/1985 | Baugh | |
| 4,575,155 A | | 3/1986 | Hodges | |
| 4,628,996 A | * | 12/1986 | Arnold | 166/116 |
| 4,969,513 A | * | 11/1990 | Barrus et al. | 166/53 |
| 5,366,030 A | | 11/1994 | Pool, II et al. | |
| 5,507,465 A | | 4/1996 | Borle | |
| 5,906,238 A | * | 5/1999 | Carmody et al. | 166/53 |

* cited by examiner

*Primary Examiner*—Hoang Dang
(74) *Attorney, Agent, or Firm*—Domingue & Waddell, PLC

(57) ABSTRACT

An inflatable sealing assembly integrated with a flow carrier which seals the inside of the flow carrier upon detection of a physical condition (e.g. fluid pressure). The inflatable sealing assembly includes a housing, a compartment in the interior of the housing for storing an inflatable sealing device, an inflating mechanism, and a sensor. Upon detection of the physical condition in the exterior and/or interior of the flow carrier, the sensor activates the inflating mechanism, preferably automatically, to inflate and deploy the inflatable sealing device which seals off the inside of the flow carrier. The inflatable sealing device may be an air bag.

57 Claims, 8 Drawing Sheets

INFLATABLE SEALING ASSEMBLY AND METHOD FOR SEALING OFF AN INSIDE OF A FLOW CARRIER

FIELD OF THE INVENTION

The present invention relates to an inflatable sealing assembly for sealing off an inside of a flow carrier and more particularly to an inflatable sealing assembly for sealing a flow bore in a tubular which is capable of being integrated with the tubular and which preferably seals the flow bore automatically in response to the detection of a physical condition affecting the tubular. The present invention also relates to a method of sealing off an inside of a flow carrier by inflating and deploying an inflatable sealing device.

BACKGROUND OF THE INVENTION

A flow carrier may be any structure through which media may be transported. The flow carrier may have a cross-section area that is shaped in a variety of configurations such as circular, square, rectangular, splined, or uneven. The flow carrier may be a tubular. A tubular may be any tube through which material is transported. A tubular may be comprised of a single tube or a series of tubes connected together. A pipeline which transports oil or gas is an example of a tubular. Other examples of tubulars include a well casing within which a work string may be positioned or a well pipe through which hydrocarbons may be produced.

The detection and control of physical conditions (e.g., fluid pressure, fluid speed, etc.) in a tubular are important to ensure the regulated transport and release of materials through and from the tubular. When physical conditions exceed those normally present in the tubular, the materials may be released from the tubular in an uncontrolled manner as for example when a blowout occurs or at an undesired location as for example when the tubular ruptures.

A blowout of an oil or gas well occurs when there is an uncontrolled release of hydrocarbons from the well annulus or bore. The weight of the column of drilling fluid in the well annulus normally exerts sufficient downward force as to control the downhole pressures which force the hydrocarbons upward to the well's surface. When the counter-pressure exerted by the weight of the drilling fluid no longer controls the downhole pressure, a blowout occurs resulting in the uncontrolled release at the well surface of the hydrocarbons.

Blowouts of oil and gas wells are undesired. Blowouts may cause damage to rig equipment and personnel. Blowouts may cause environmental damage or pollution arising from well fires or the deposit of hydrocarbons on land or in the ocean if the blowout occurs on an off-shore rig. The blowout may also result in the loss of economic value as the well reservoir is depleted. There is also the added expense of capping the well and replacing equipment in order to resume normal drilling or production activities.

Blowout preventers have been developed to prevent well blowouts. Most blowout preventers are surface equipment which are manually activated by a member of the drilling or production crew when readings on the master control panel indicate that pressures in the well annulus have increased to a point that a blowout may take place. The crew member presses a switch on the master control panel which causes activation of the blowout preventer. The blowout preventer closes the annulus with two large hydraulic rams or alternatively piston and wedge elements are engaged which squeeze a rubber gasket around the drill pipe to seal the opening between the outer surface of the drill pipe and the well annulus.

Because the crew member may not be paying attention to the pressure readings on the control panel or not appreciate that blowout conditions exist, automatic blowout preventers have been developed.

U.S. Pat. No. 5,507,465 describes an automatic surface blowout preventer. The blowout preventer is activated when the annulus pressure exceeds a preset hydraulic pressure in the fluid chamber of a piston in the blowout preventer. This causes the piston to move upward thereby forcing a wedge assembly to press against the drill pipe extending through the central drill pipe bore of the blowout preventer and into a sealing engagement therewith.

U.S. Pat. No. 3,717,203 describes an automatic subsurface blowout preventer. The blowout preventer is positioned in a flow tube which is connected to a packer. The packer is set in a well pipe or casing. The blowout preventer includes a rigid housing attached to the end of the flow tube. The housing's interior contains a collapsible sleeve made of rubber or a rubber like material. Slots in the housing expose the sleeve to fluid pressure. During normal fluid flow, the sleeve is pressed against the housing's inner wall by the pressure of the fluid flowing upward through the housing. This maintains a flow bore through the sleeve so that the fluid is able to flow from the casing through the bore in the sleeve and up through the tubing to the well surface. When well pressure increases to a point that a blowout may occur, the rapidly flowing fluid creates a pressure drop through the inside of the sleeve so that a pressure differential is created across the wall of the sleeve which is sufficient to collapse the sleeve. This closes the flow bore through the sleeve and stops the upward flow of the fluid to the well surface.

Despite the developments of automatic blowout preventers, the need still exists for an improved blowout preventer that is capable of being integrated with the tubular and which quickly and effectively seals the flow bore in the tubular when conditions require such sealing.

Accordingly, it is an object of the present invention to provide an improved blowout preventer which is capable of being integrated with the tubular and which provides a reliable and effective inflatable sealing mechanism that may be automatically activated upon the detection of possible blowout conditions.

It is to be understood that the present invention is not limited to use as a blowout preventer. The present invention may be used with a variety of flow carriers or tubulars in other applications to seal off the inside of the flow carrier or to seal the flow bore of the tubular.

SUMMARY OF INVENTION

The present invention provides a novel inflatable sealing assembly which is capable of being integrated with a flow carrier such as a tubular. The inflatable sealing assembly may be integrated with the flow carrier by coupling or connecting the assembly between sections of the flow carrier. When integrated with the flow carrier, the inflatable sealing assembly (in its non-deployed position) does not obstruct the flow path of materials such as fluids that are being transported through the inside of the flow carrier.

To achieve this unobstructed flow path, the components of the inflatable sealing assembly involved in the sealing of the inside of the flow carrier are incorporated in the assembly's housing until deployed. These components may include a sensor to detect a physical condition affecting the flow carrier, an inflating mechanism which is activated by the sensor upon detection of the physical condition, and an inflatable sealing device that inflates when the inflating mechanism is activated. When inflated, the inflatable sealing device deploys and seals off the inside of the flow carrier. Media such as fluid is therefore prevented from being transported in the flow carrier past the point where the deployed inflatable sealing device has sealed the inside of the flow carrier.

In one embodiment of the present invention the inflating mechanism may be a device for delivering compressed air or other gas to the inflatable sealing device. The inflating mechanism may alternatively be a device which includes chemicals that when mixed together or exposed to each other combine or react to produce a gas that inflates and deploys the inflatable sealing device to seal the flow carrier. The inflatable sealing device preferably is a material that is able to fold so that it may be stored in a compartment in the housing of the assembly and inflate when filled with gas to seal the inside of the flow carrier. Preferably, the inflatable sealing device is in the form of an air bag. For applications in which an object such as a work string is positioned in the inside of the flow carrier, the inflatable sealing device is preferably in the form of a donut-shaped air bag which is able to deploy around the outer surface of the object to seal the inside of the flow carrier.

In another embodiment of the present invention the inflatable sealing assembly is activated to seal off the inside of the flow carrier automatically when a physical condition affecting the flow carrier is detected. The sensor preferably automatically activates the inflating mechanism upon detection of the physical condition. The inflating mechanism then automatically inflates and deploys the inflatable sealing device to seal off the inside of the flow carrier. The sensor may be pre-set to cause activation of the inflating mechanism when a specific or pre-selected physical condition is manifested which affects the flow carrier. Preferably, the physical condition that is detected by the sensor affects the external surface of the flow carrier and/or affects the interior of the flow carrier. It is preferred if the physical condition detected by the sensor is pressure, velocity, temperature, vibration, noise, density, odor, color, chemical composition, or any combination thereof. More preferably, the sensor detects a pre-selected fluid pressure in the inside of the flow carrier to activate the inflating mechanism.

In another embodiment of the present invention the compartment storing the non-deployed inflatable sealing device may be covered. The cover may be part of the housing's inner wall which has one or more detachable or movable sections that disengage from the compartment's opening when the inflatable sealing device is deployed. The cover may also be a slidable wedge-shaped member that moves away from the compartment's opening when the inflatable sealing device is deployed. The slidable wedge-shaped member may also function to wedge against an object such as a work string that may be positioned within the inside of the flow carrier and thereby assist in the sealing of the inside of the flow carrier when the inflatable sealing device is deployed.

In yet a further embodiment of the present invention the inflatable sealing device, when inflated, disassociates or disengages from the housing of the inflatable sealing assembly and may move within the inside of the flow carrier to a different location or area of the flow carrier where the inflatable sealing device seals the inside of the flow carrier. Preferably, the different location or area where the inflatable sealing device moves has a reduced diameter. The deployed inflatable sealing device is preferably larger than the area of reduced diameter of the flow carrier. Because of this, the deployed inflatable sealing device as it travels through the inside of the flow carrier, comes to rest against, plug, and seal the inside of the flow carrier at the area of reduced diameter.

The method of the present invention includes integrating the inflatable sealing assembly in or with a flow carrier and permitting the sensor to detect a physical condition affecting the flow carrier. Preferably, the sensor detects a change in a physical condition affecting the flow carrier. The sensor preferably detects a change in a physical condition affecting the exterior and/or interior of the flow carrier. More preferably, the sensor detects a change in the physical condition of the media being transported through the inside of the flow carrier. Upon detection of the physical condition, the sensor triggers the inflating mechanism which then inflates and deploys the inflatable sealing device to seal the inside of the flow carrier.

In a further embodiment of the method of the present invention, the inflated and deployed inflatable sealing device is deflated. The deflation of the inflated and deployed inflatable sealing device may be accomplished by external manipulation of the inflatable sealing device, as for example, by piercing the device with an external tool. Deflation may also be accomplished by internal mechanisms, as for example by activation of a deflation device (e.g., a release valve).

In a further embodiment of the method of the present invention, two or more inflatable sealing assemblies are integrated with the flow carrier. The assemblies may be positioned at intervals in the flow carrier between sections thereof.

DESCRIPTION OF THE PREFERRED EMBODIMENTS

Figure 1:
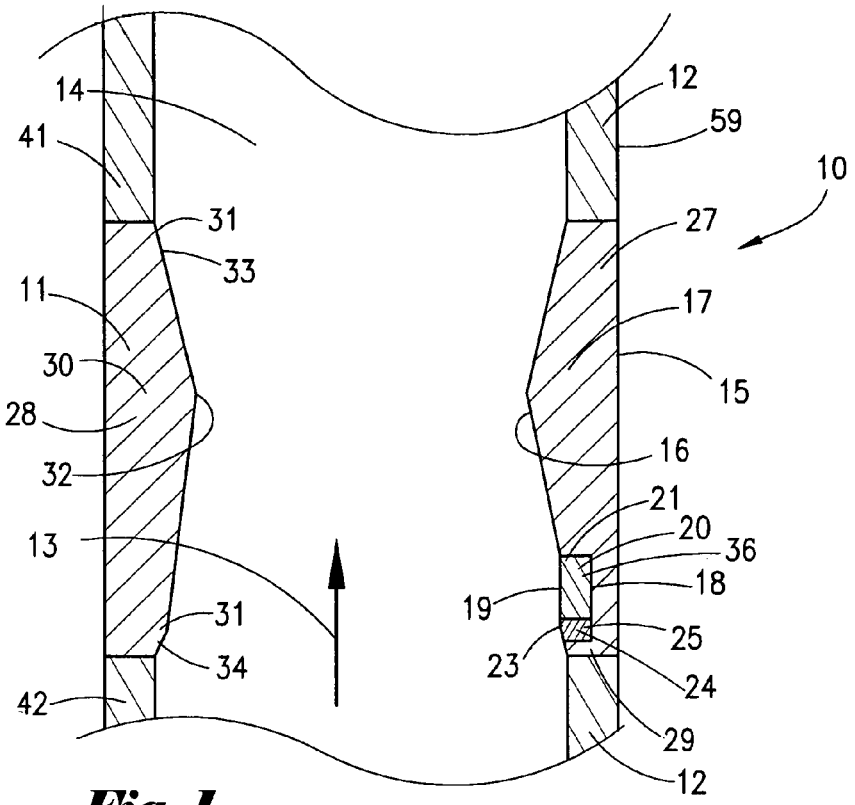
FIG. 1 is a cross-sectional view of an embodiment of the inflatable sealing assembly of the present invention shown integrated with a tubular and in a non-deployed position.

With reference to the figures where like elements have been given like numerical designation to facilitate an understanding of the present invention, and particularly with reference to the embodiment of the inflatable sealing assembly of the present invention illustrated in FIG. 1, the inflatable sealing assembly 10 may be constructed with housing 11. Housing 11 preferably is capable of being integrated with tubular 12 to permit an unobstructed flow of media 13 through flow bore 14 in tubular 12. Housing 11 may be made of any structurally rigid material. Preferably, housing 11 is constructed of steel.

Media 13 may be a variety of different materials such as fluid (water, oil, acids, and the like) or compressible media (natural gas, nitrogen, and the like) or slurries with particles (drilling fluid, ore slurry, and the like).

As shown in FIG. 1, housing 11 may include outer wall 15, inner wall 16, and interior 17 between outer and inner walls 15, 16. Preferably, inner wall 16 defines part of flow bore 14 in tubular 12 when inflatable sealing assembly 10 is integrated with tubular 12.

Figure 3:
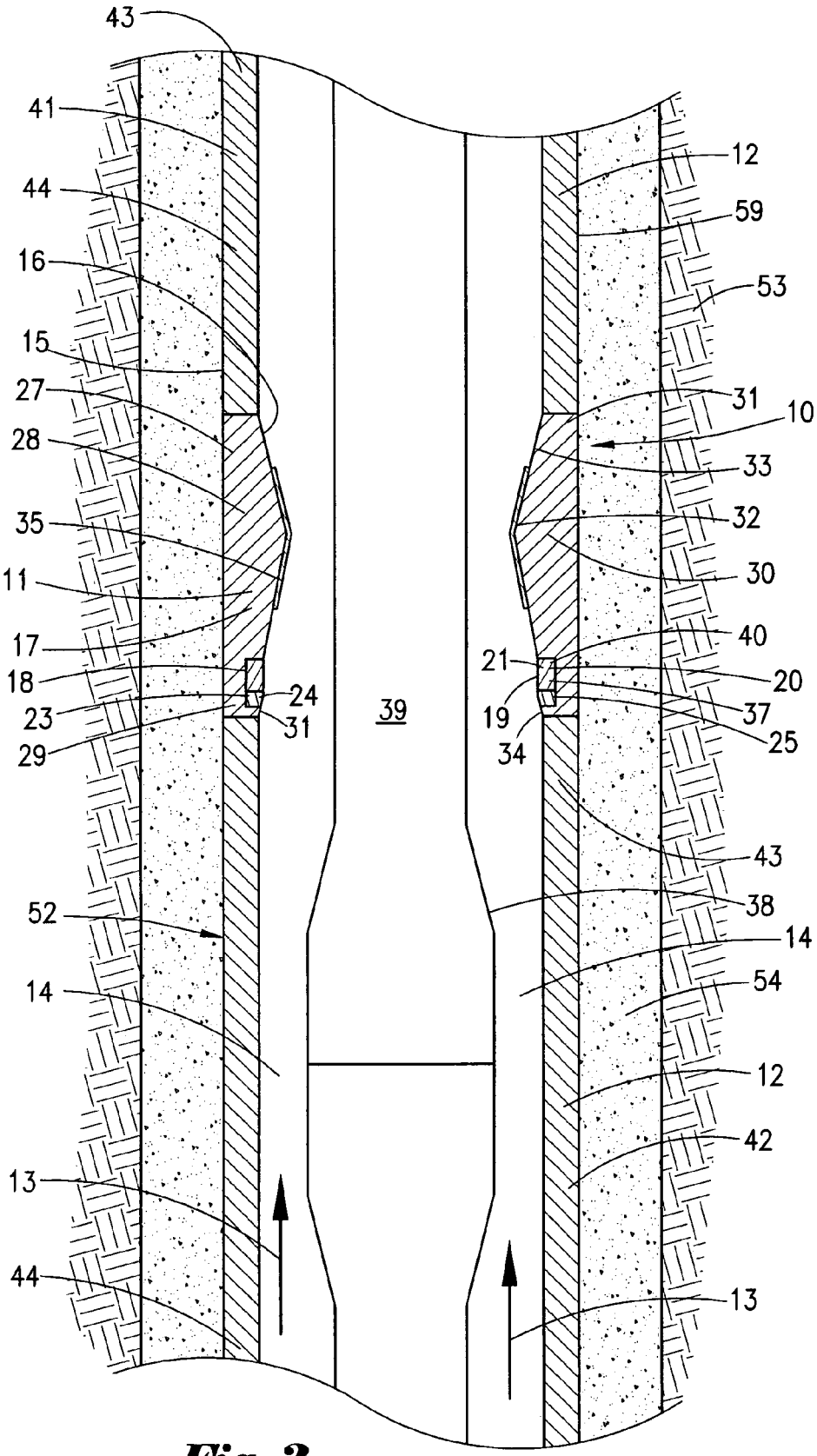
FIG. 3 is a cross-sectional view of another embodiment of the inflatable sealing assembly of the present invention shown integrated with a well casing in a non-deployed position and with a work string positioned in the flow bore.

FIG. 3 illustrates that housing 11 may be cylindrical and may have top section 27, central section 28, and bottom section 29. Preferably, central section 28 has width 30 which is greater than width 31 of each of top section 27 and bottom section 29. Thus, inner wall 16 of housing 11 is tapered from central section 28 (preferably from portion 32) to each of portion 33 of top section 27 and portion 34 of bottom section 29. This tapering of inner wall 16 acts to protect inflatable sealing assembly 10 when integrated in tubular 12 (particularly when protective plate 35 as described below is used therewith) and acts to guide longitudinally extending object 39 (e.g., a work string) which may be run through inflatable sealing assembly 10 when integrated in tubular 12.

In the preferred embodiments of the present invention shown in FIGS. 1–10, inflatable sealing assembly 10 may be integrated with tubular 12 wherein tubular 12 may include at least first tubular section 41 and second tubular section 42. First and second tubular sections 41, 42 each may have top end 43 and bottom end 44. Preferably, top section 27 of housing 11 is connected to bottom end 44 of first tubular section 41 and bottom section 29 of housing 11 is connected to top end 43 of second tubular section 42. More preferably, top section 27 of housing 11 is threadedly connected to bottom end 44 of first tubular section 41 and bottom section 29 of housing 11 is threadedly connected to top end 43 of second tubular section 42.

FIG. 3 demonstrates that inner wall 16 of housing 11 may include protective plate 35 that is structurally strengthened to protect inner wall 16 from damage caused by running or positioning of longitudinally extending object 39 (e.g., work string) in tubular 12 when inflatable sealing assembly 10 is integrated therewith. Protective plate 35 (preferably a steel plate) may be either be incorporated into inner wall 16 or affixed thereto by welding or other suitable bonding technique.

Again, with reference to FIG. 1, compartment 18 may be provided in interior 17 of housing 11. Preferably, compartment 18 has opening 19 that provides access to flow bore 14 of tubular 12 when inflatable sealing assembly 10 is integrated with tubular 12. Compartment 18 is preferably positioned in bottom section 29 of housing 11 within interior 17 as shown in FIGS. 1–3.

The size of compartment 18 may vary depending on the size of inflatable sealing means 20 that is to be stored therein. Preferably, the size of compartment 18 is such that it accommodates inflatable sealing means 20 in non-deployed position 21 while leaving sufficient space so that inflatable sealing means 20 is able to be deployed from compartment 18.

Figure 5:
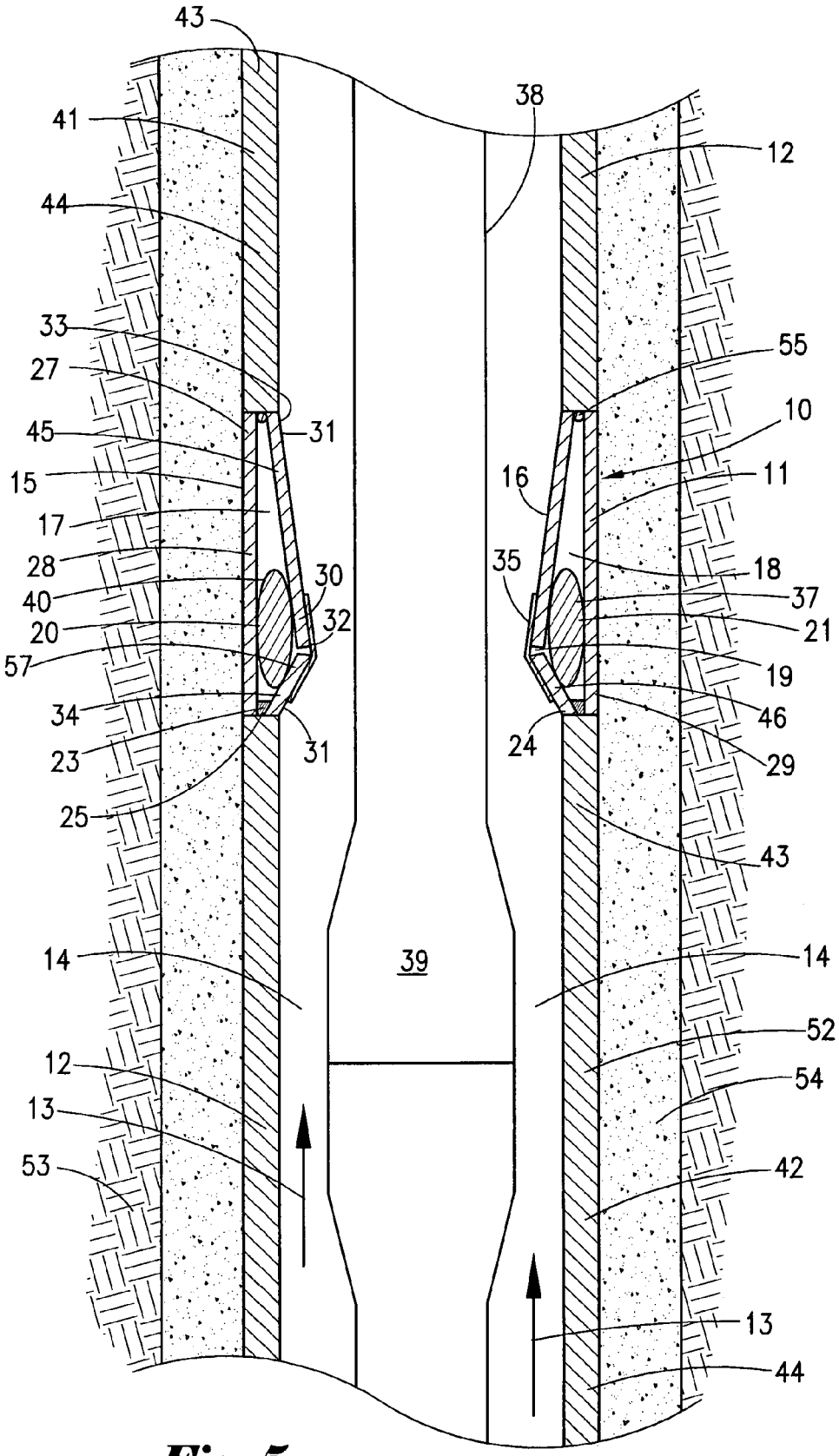
FIG. 5 is a cross-sectional view of another embodiment of the inflatable sealing assembly of the present invention having detachable inner wall sections and which is shown integrated with a well casing in a non-deployed position and with a work string positioned in the flow bore.
Figure 6:
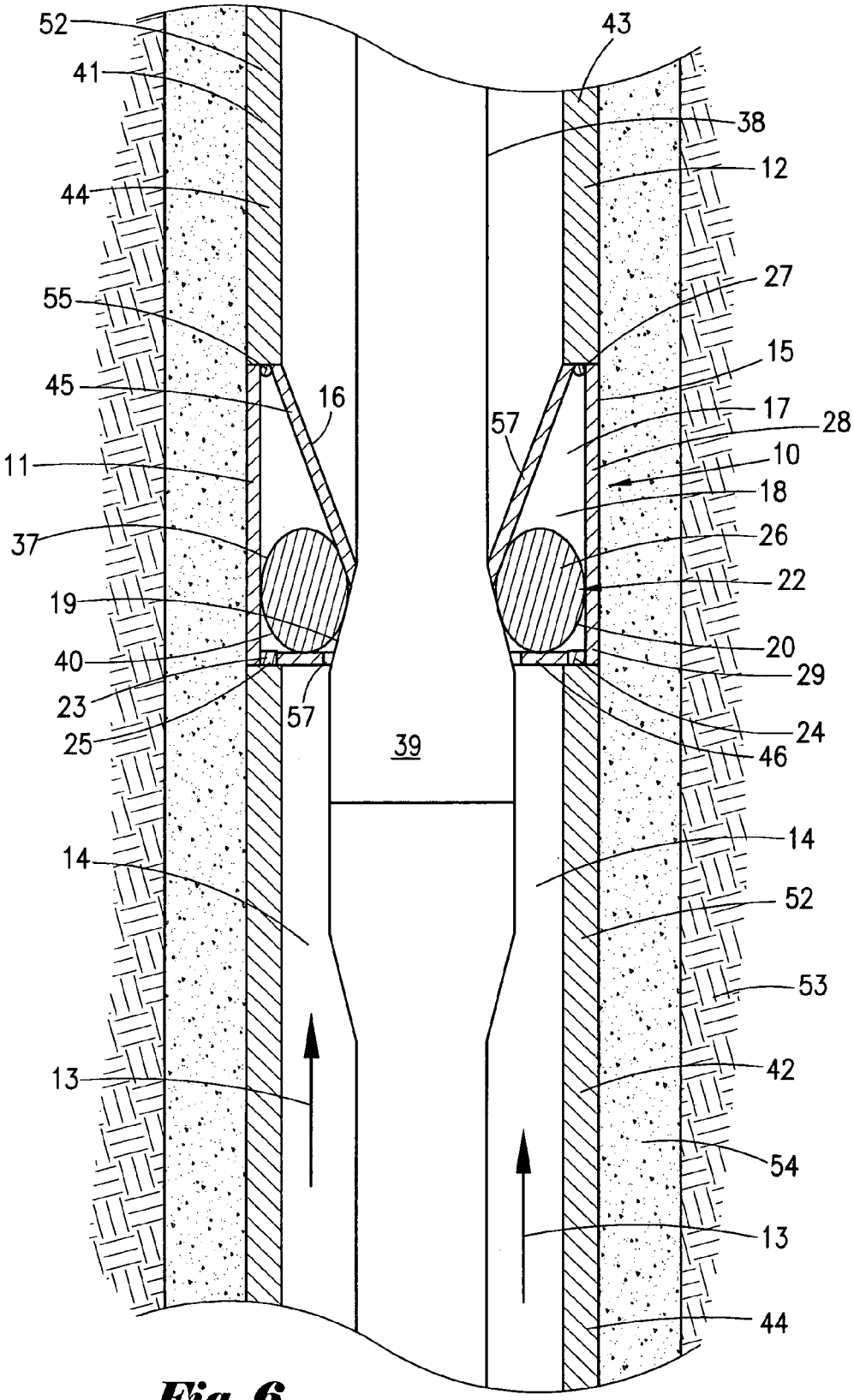
FIG. 6 is a cross-sectional view of the embodiment of the inflatable sealing assembly of the present invention shown in FIG. 5 in a deployed position.

Compartment 18 may be a cutout in interior 17 of housing 11 as shown in FIGS. 1–3 and 7–10. Alternatively as shown in FIGS. 5 and 6, compartment 18 may comprise all or part of interior 17 of housing 11. It is to be understood that interior 17 of housing 11 shown in FIGS. 5 and 6 could be modified to include separate compartment 18 (not shown) which may be formed in part from metal or plastic plates perpendicularly affixed to outer wall 15 within interior 17 in such a manner that enables inner wall 16 to partly disengage in order to provide opening 19 so that inflatable sealing means 20 may be deployed.

Figure 2:
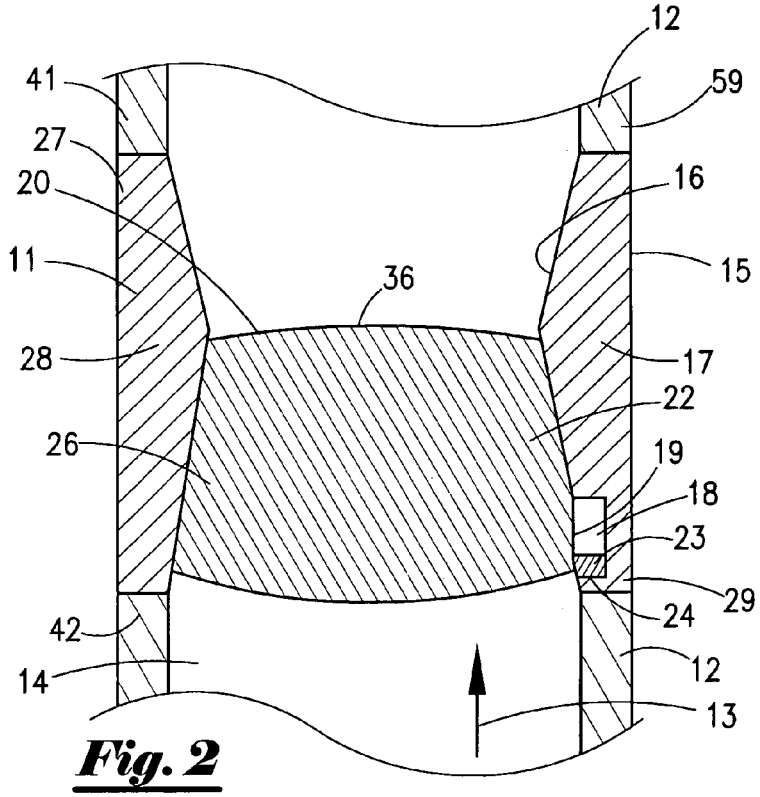
FIG. 2 is a cross-sectional view of the embodiment of the inflatable sealing assembly of the present invention shown in FIG. 1 in a deployed position.

FIGS. 1 and 2 reveal that housing 11 may include inflatable sealing means 20. Preferably, inflatable sealing means 20 has a non-deployed position 21 (FIG. 1) and a deployed position 22 (FIG. 2). When in non-deployed position 21, it is preferred that inflatable sealing means 20 is stored substantially within compartment 18.

It is preferred that inflatable sealing means 20 is air bag 36. Air bag 36 may be made of any material that is capable of being folded so that it can be stored in compartment 18 (which may be of limited space) and thereafter inflated upon activation of inflating means 20. The material used to construct air bag 36 must also be able to contain gas 26 which inflates air bag 36 for an extended period of time in order to maintain the seal formed by air bag 36 when it is inflated in flow bore 14.

Preferably, the material used to construct air bag 36 is relatively thin, nylon fabric or other woven fabric which is able to withstand the physical forces that may be present in tubular 12, as for example hydrocarbon temperature and pressure. A rubber or rubber like material could also be used to form air bag 36 so long as it is capable of folding for storage in compartment 18 and inflating when gas 26 is introduced therein. The size and shape of inflatable sealing means 20 and in particular air bag 36 is dependent on the area or diameter of the specific flow bore 14 which is to be sealed.

Because inflatable sealing means 20 is inflatable and elastic, inflatable sealing means 20 is able to conform to the shape of the objects in flow bore 14 or the shape of the cross sectional area of flow bore 14 (which can be any shape such as circular, square, spline shaped, etc.) and thereby seal flow bore 14. Thus, inflatable sealing means 20 is adaptable and able to seal all manner of tubulars regardless of their internal shapes or what objects are positioned therein.

FIGS. 1 and 2 also demonstrate that housing 11 may include inflating means 23. Preferably, inflating means 23 is capable of deploying inflatable sealing means 20 from non-deployed position 21 to deployed position 22. Inflating means 23 is preferably positioned in interior 17 of housing 11, preferably in bottom section 29. More preferably, inflating means 23 is operatively connected to inflatable sealing means 20 so that when activated it will cause inflatable sealing means 20 to inflate and seal flow bore 14 in tubular 12.

Inflating means 23 may be any device that is capable of inflating inflatable sealing means 20. Inflating means 23 preferably is any type of device which is capable of introducing gas 26 into inflatable sealing means 20. For example, inflating means 23 may be compressed air or other compressed gas 26 which is stored under pressure and then discharged into inflatable sealing means 20 when sensor 24 detects a physical condition which signifies that sealing of flow bore 14 is necessary. To open the reservoir housing compressed gas 26, inflating means 23 may include a diaphragm separating compressed gas 26 from inflatable sealing means 20 that may be ruptured by mechanical techniques upon activation by sensor 24.

Inflating means 23 may for example be a gas generator having a rapidly burning propellant composition stored therein for producing substantial volumes of gas 26 which is then directed into inflatable sealing means 20. Gas generators of the type that may be used in the present invention generally use solid fuel gas generating compositions and generally include an outer metal housing, a gas generating composition located within the housing, an igniter to ignite the gas generating composition in response to a signal received from a sensor (e.g., sensor 24 positioned at a location removed from the generator) and, if necessary, a device to filter and cool gas 26 before gas 26 is discharged into inflatable sealing means 20.

It is to be understood that various gas generators may be used as inflating means 23 so long as they produce a sufficient volume of gas 26 to inflate and deploy inflatable sealing means 20. Also various gas compositions may be used. Preferably, the gas generating compositions used with inflating means 23 including for example reacting sodium azide ($NaN_3$) with potassium nitrate ($KNO_3$) to produce nitrogen gas.

As also shown in FIGS. 1 and 2, sensor means 24 may be operatively connected to inflating means 23. Preferably, sensor means 24 is capable of detecting a physical condition affecting tubular 12 and upon detection of the physical condition, of activating inflating means 23 to inflate and deploy inflatable sealing means 20.

Sensor means 24 may be positioned anywhere in tubular 12 so long as sensor means 24 is capable of detecting the physical condition affecting tubular 12. For example, sensor means 24 may in part be positioned on or in tubular 12 and more preferably on or near the external surface 59 of tubular 12 particularly when sensor means 24 is designed to detect a physical condition affecting tubular 12 or affecting external surface 59 of tubular 12. Alternatively, sensor means 24 may be positioned in part on or near housing 11 of inflatable sealing means 10 particularly when sensor means 24 is designed to detect a physical condition within flow bore 14. It is preferred, however, that sensor means 24 be positioned at least in part within interior 17 of housing 11. It is also preferred that sensor means 24 automatically activates inflating means 23 upon detection of the physical condition affecting tubular 12.

It is to be understood that sensor means 24 may detect a physical condition affecting external surface 59 of tubular 12 or affecting flow bore 14 of tubular 12 or both. It should also be understood that more than one sensor means 24 may be provided as part of inflatable sealing assembly 10 which may detect the same physical condition affecting tubular 12 or one or more different physical conditions affecting tubular 12. Also, one sensor means 24 may be provided that has the capability to detect more than one physical condition affecting tubular 12 and/or physical conditions affecting tubular 12 that may be manifested in various locations on or in tubular 12, as for example, external surface 59 or in flow bore 14.

As described, sensor means 24 may be any sensor that detects one or more specific physical conditions in or affecting tubular 12. The physical condition affecting tubular 12 that may be detected by sensor means 24 includes any physical condition indicative of potential harm or destruction to tubular 12. For example, sensor means 24 may detect physical conditions such as the following: pressure exerted on or inside tubular 12; the velocity of media 13 traveling in flow bore 14; the external or internal temperature of tubular 12 or of media 13 in flow bore 14; the vibration of tubular 12; the noise around or in tubular 12; the density of tubular 12 or of media 13 in tubular 12; the odor or color of media 13 in flow bore 14; the chemical composition of media 13 in flow bore 14; or any combination thereof. Sensors for detecting the aforesaid physical conditions are commercially available.

The physical condition detected by sensor means 24 is preferably a change in a physical condition affecting tubular 12 or more preferably a change in physical condition affecting or arising in or from flow bore 14 or media 13 in flow bore 14. Preferably, the physical condition detected by sensor 24 is a change in fluid pressure within flow bore 14 and more preferably in media 13. In order to detect the fluid pressure, sensor means 24 may be any type of sensor that is capable of detecting fluid pressure, as for example a pressure switch. Sensor means 24 preferably detects and activates inflating means 23 when a pre-selected fluid pressure is reached in flow bore 14. For example, when the fluid pressure in flow bore 14 reaches the pre-selected threshold level determinative of a physical condition necessitating the sealing of flow bore 14 (e.g., when fluid pressure is such that it may signal that blowout conditions exist), a switch such as a snap-acting diaphragm in sensor 24 is initiated, as for example by having the snap-acting diaphragm reverse its curvature, which opens or closes a set of electrical contacts causing inflating means 23 to inflate and deploy inflatable sealing means 20.

It is to be understood that when inflatable sealing means 20 is inflated and deployed it may be either attached or secured to housing 11 or it may be disassociated or disengaged from housing 11. If disassociated or disengaged from housing 11, inflatable sealing means 20 as deployed may be located within flow bore 14 adjacent to or near housing 11 as shown in FIG. 2. FIG. 2 also shows that tubular 12 has an area of reduced diameter created by the integration of inflatable sealing assembly 10 with tubular 12; the reduced diameter area being formed in particular by the tapering of inner wall 16 of housing 11. Thus, the tapered inner wall 16, having established an area in tubular 12 of reduced diameter, holds and assists inflatable sealing means 20 to seal flow bore 14 when in deployed position 22. In an embodiment not shown, inflatable sealing means 20 may move within flow bore 14 when it disassociates or disengages from housing 11. This would be desirable if the intent is to seal flow bore 14 at a location that is not in close proximity to housing 11. For example, inflated and deployed inflatable sealing means 20 may move within flow bore 14 (e.g., by force of media 13) to a different location or area of tubular 12 where inflatable sealing means 20 seals flow bore 14 in tubular 12 at said different location or area. Preferably, the different area or location within tubular 12 has a reduced diameter. Preferably, inflated and deployed inflatable sealing means 20 is larger in size than the area of reduced diameter so that inflatable sealing means 20 comes to rest or abuts against the area of reduced diameter and plug and seal flow bore 14 at this area.

Figure 4:
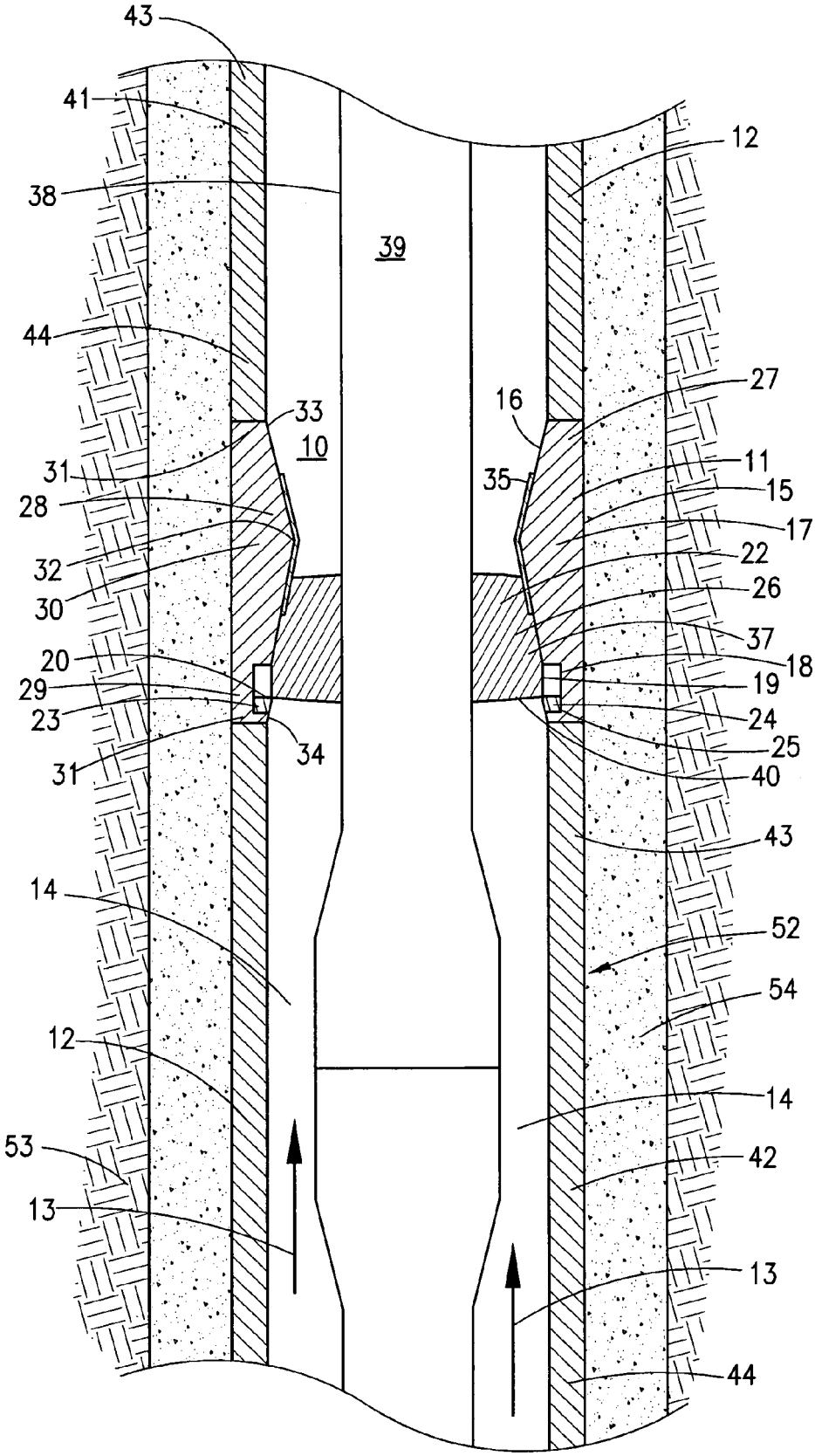
FIG. 4 is a cross-sectional view of the embodiment of the inflatable sealing assembly of the present invention shown in FIG. 3 in a deployed position.

An alternative embodiment of inflatable sealing assembly 10 of the present invention is shown in FIGS. 3 and 4. In this embodiment, compartment 18 extends substantially around the circumference of cylindrical housing 11 and more preferably substantially around the circumference of inner wall 16 of cylindrical housing 11. Inflatable sealing assembly 10 is provided with inflatable sealing ring 37. In non-deployed position 21, inflatable sealing ring 37 is stored substantially within compartment 18.

Inflatable sealing ring 37 is designed so that when it is in deployed position 22 inflatable sealing ring 37 is inflated and compresses against outer surface 38 of longitudinally extending object 39 (e.g., a work string) which may be positioned within flow bore 14. Upon inflation and deployment of inflatable sealing ring 37, inflatable sealing ring 37 seals flow bore 14 in tubular 12 between inner wall 16 of cylindrical housing 11 and outer surface 38 of object 39. Preferably, inflatable sealing ring 37 is in the form of donut-shaped air bag 40. Donut-shaped air bag 40 may have a central opening which accommodates object 39 that may be positioned in flow bore 14.

With reference to FIGS. 5 and 6, inner wall 16 of cylindrical housing 11 may provide a cover for opening 19 in compartment 18 when inflatable sealing ring 37 is in non-deployed position 21. Preferably, inner wall 16 includes at least first section 45 and second section 46. More preferably, sections 45 and 46 each have end 57 which are capable of being detachably connected together. Deployment of inflatable sealing ring 37 may cause ends 57 to detach and expose opening 19 in compartment 18 so as to permit inflatable sealing ring 37 to inflate and deploy in flow bore 14 as shown in FIG. 6.

FIG. 6 also shows that when inflatable sealing ring 37 is deployed, first section 45 of inner wall 16 may be swung about pivot means 55 so that end 57 of first section 45 abuts outer surface 38 of longitudinally extending object 39, which may provide further sealing of flow bore 14 and which may provide assistance in changing (stopping) of movement of longitudinally extending object 39. Second section 46 may move in the opposite direction from first section 45 and may come to rest at a position perpendicular to outer wall 15 of cylindrical housing 11.

In this position, second section 46 may provide support for a portion of inflatable sealing ring 37. Pivot means 55 may be located in interior 17 at top section 27. Pivot means 55 may be any device which assists in the pivoting of first section 45 when inflatable sealing ring 37 is inflated and deployed to deployed position 22. Although not shown, second section 46 may have associated therewith a pivot device which assists in the pivoting or movement of second section 46.

Figure 7:
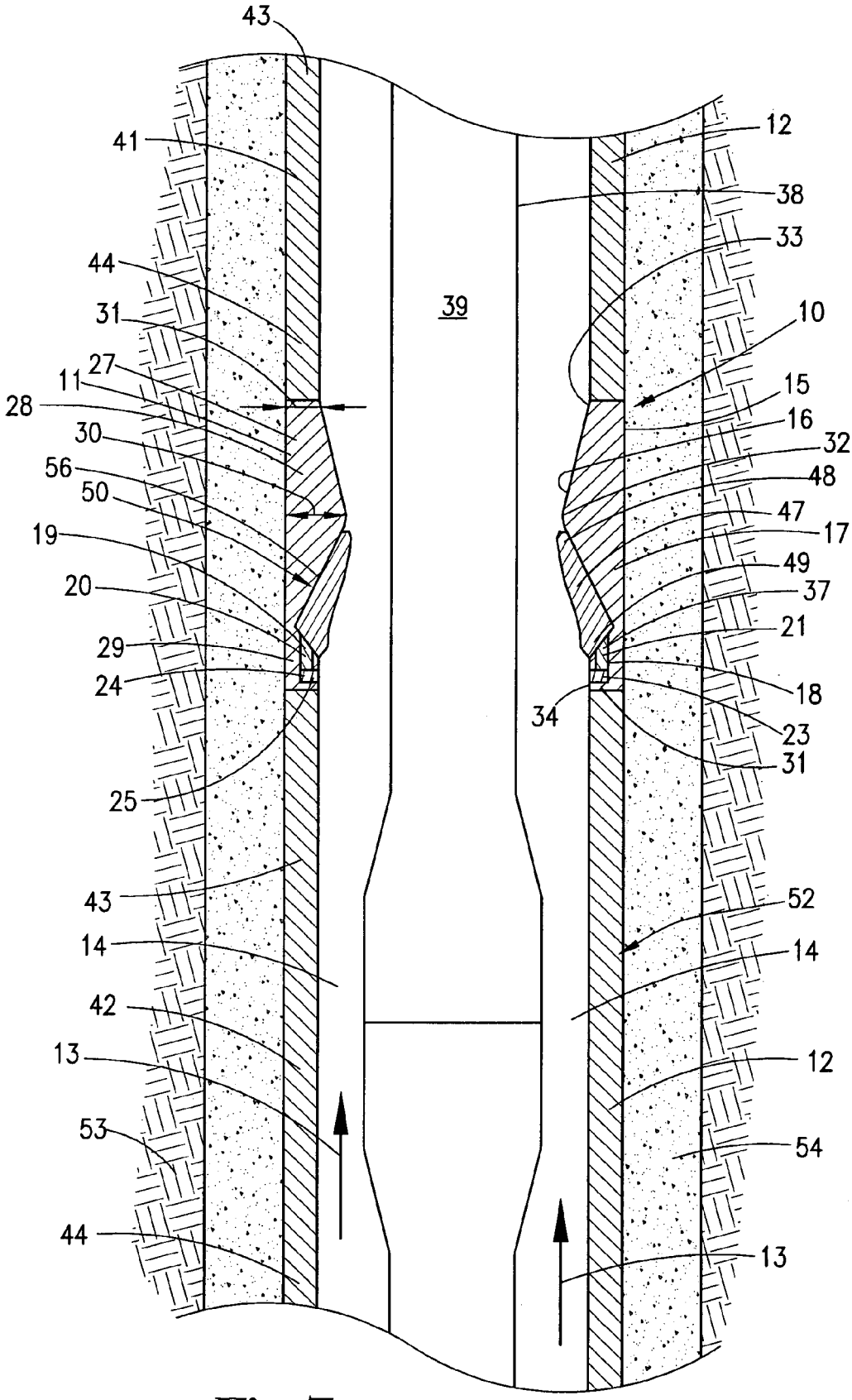
FIG. 7 is a cross-sectional view of another embodiment of the inflatable sealing assembly of the present invention having a slidable wedged-shaped member and which is shown integrated with a well casing in a non-deployed position and with a work string positioned in the flow bore.
Figure 8:
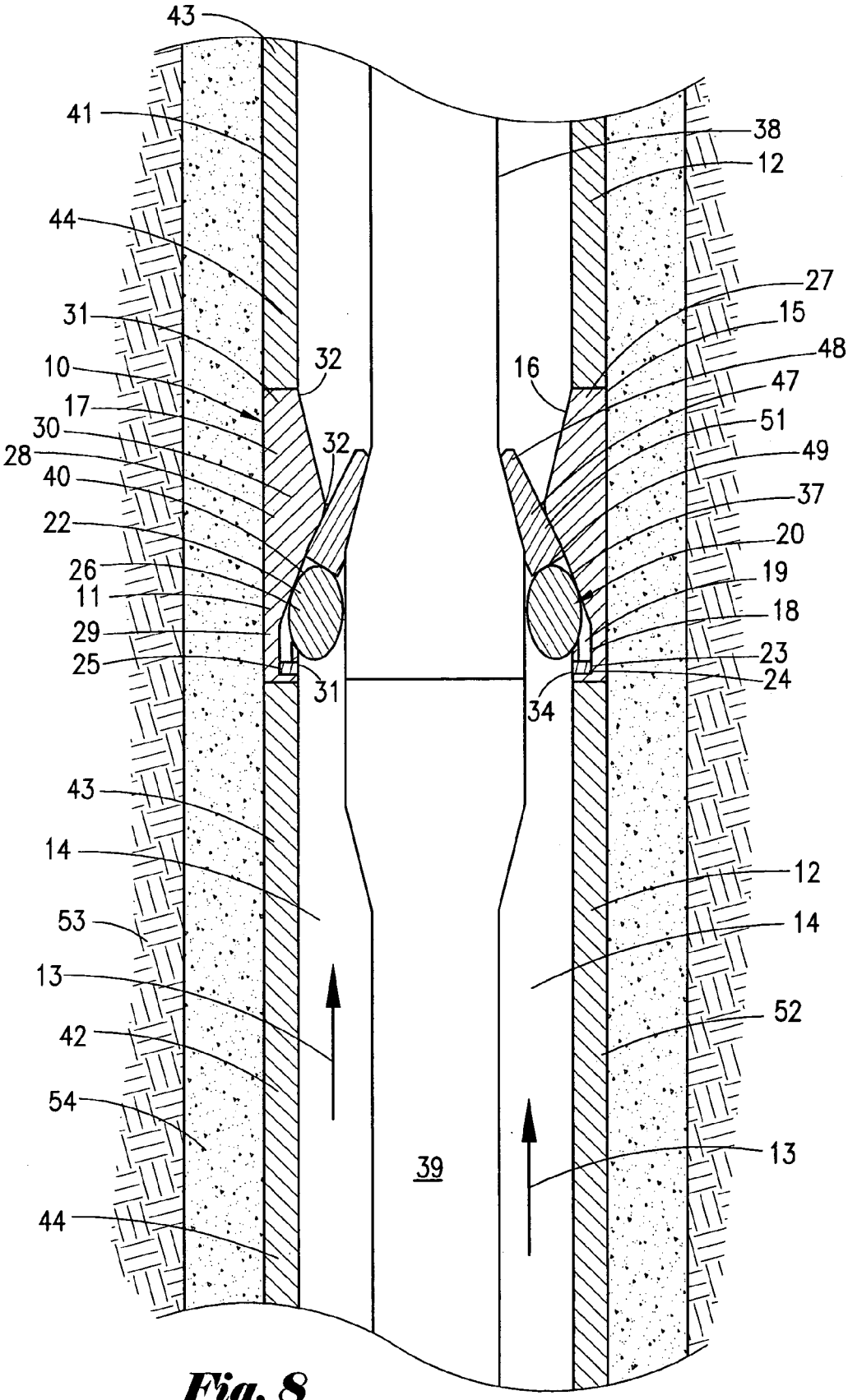
FIG. 8 is a cross-sectional view of the embodiment of the inflatable sealing assembly of the present invention shown in FIG. 7 in a deployed position.

FIGS. 7 and 8 illustrate another preferred embodiment of inflatable sealing assembly 10. Cylindrical housing 11 preferably includes slidable wedge-shaped member 47. Slidable wedge-shaped member 47 may be positioned on inner wall 16 of cylindrical housing 11. Slidable wedge-shaped member 47 preferably includes first end 48 and second end 49. When inflatable sealing ring 37 is in non-deployed position 21, second end 49 of slidable wedge-shaped member 47 provides a cover for opening 19 in compartment 18. In this position, slidable wedge-shaped member 47 is in closed position 50.

Preferably, slidable wedge-shaped member 47 is operatively connected to inflatable sealing ring 37 such that when inflatable sealing ring 37 is inflated and deployed, second end 49 of slidable wedge-shaped member 47 is positioned away from opening 19 in compartment 18 with first end 48 of slidable wedge-shaped member 47 abutted or wedged against outer surface 38 of longitudinally extending object 39 thus mechanically restraining longitudinally extending object 39 in position. In this position, slidable wedge-shaped member 47 is in open active position 51.

When slidable wedge-shaped member 47 transitions from closed position 50 to open position 51, slidable wedge-shaped member 47 preferably slides on tapered section 56 of inner wall 16. Preferably, tongue and groove, dovetail, or other similar mechanisms are provided in slidable wedge-shaped member 47 and tapered section 56 to ensure proper contact and sliding action between slidable wedge-shaped member 47 and tapered section 56.

It is preferred, but not restricted, that slidable wedge-shaped member 47 be made in whole or in part of a deformable or compressible material such rubber or a rubber-like material so that when slidable wedge-shaped member 47 is in open position 51, second end 49 of slidable wedge-shaped member 47 forms a seal around outer surface 38 of longitudinally extending object 39.

Figure 9:
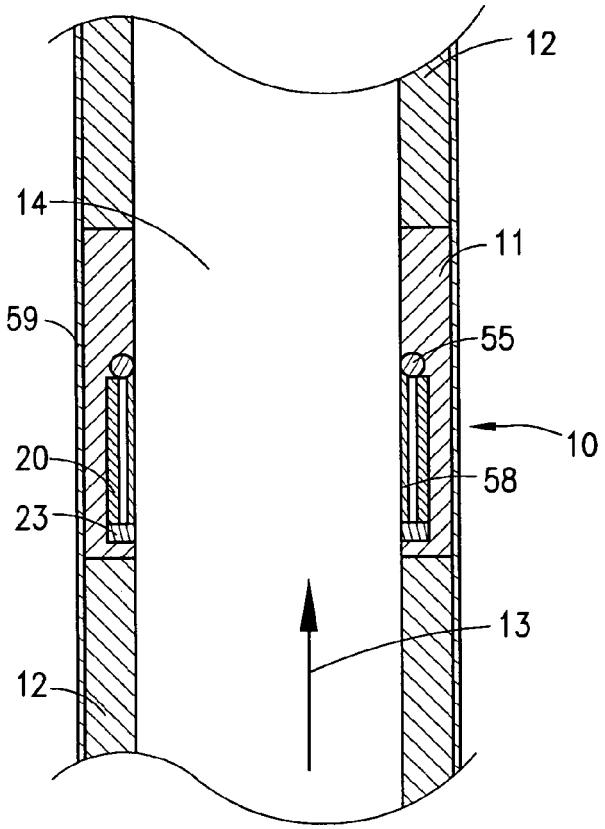
FIG. 9 is a cross-sectional view of another embodiment of the inflatable sealing assembly of the present invention having a movable inner wall section and which is shown integrated with a tubular.
Figure 10:
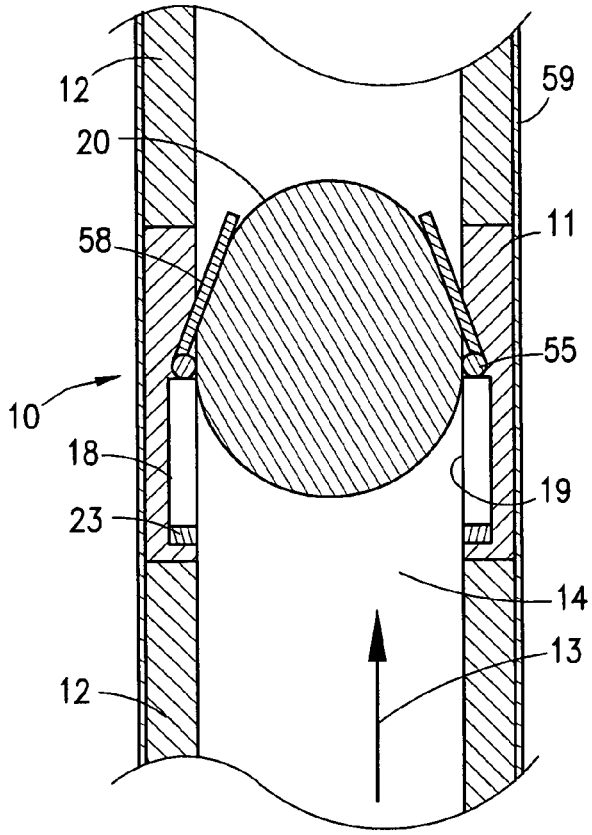
FIG. 10 is a cross-sectional view of the embodiment of the inflatable sealing assembly of the present invention shown in FIG. 9 in a deployed position.

As shown in FIGS. 9 and 10, section 58 of inner wall 16 of housing 11 is movable about pivot means 55 so that section 58 acts as a flapper mechanism covering opening 19 in compartment 18 when inflatable sealing means 20 is in non-deployed position 21 and moving away from opening 19 when inflatable sealing means 20 is in deployed position 22. By moving away from opening 19, section 58 permits deployment of inflatable sealing means 20. When section 58 of inner wall 16 is moved away from opening 19 and is in its fully extended position, section 58 acts to assist and hold inflatable sealing means 20 in sealing engagement to plug and seal flow bore 14 by providing an area and reduced diameter in flow bore 14.

The use of inflating sealing assembly 10 to seal flow bore 14 will now be described. Inflatable sealing assembly 10 is provided and integrated with tubular 12. Preferably, top section 27 of housing 11 is connected (preferably by threaded connection) to bottom end 44 of first tubular section 41 and bottom section 29 of housing 11 is connected (preferably by threaded connection) to top end 43 of second tubular section 42. Tubular 12 with inflating sealing assembly 10 integrated therewith may be used to transport materials such as media or fluid 13 through flow bore 14.

It is to be understood that inflatable sealing means 10 may be integrated with tubular 12 in various other ways. For example, inflatable sealing assembly may be positioned and held in place on the inside of tubular 12, preferably in a reduced inner cross section area of tubular 12. Inflatable sealing assembly 10 may be held in place by any positioning or fixation device such as ropes or other mechanisms which tie or detachably affix inflatable sealing assembly 10 to the inside of tubular 12. Mechanical devices such as flappers may cover inflatable sealing assembly 10 and then extend when inflatable sealing means 20 is inflated and deployed.

With the flow of media 13 through flow bore 14 of tubular 12, sensor means 24 is allowed or permitted to detect a physical condition affecting tubular 12. Preferably, the physical condition detected by sensor means 24 is a physical condition in media 13 or more preferably a change in physical condition affecting tubular 12 and/or a change in physical condition in flow bore 14 or of media 13. Such physical conditions may be pressure change or differential pressure, speed or velocity change, temperature change, vibration change, noise change, color change, odor change, density change, chemical composition change, or any combination of the aforesaid.

Upon detection of the physical condition or change in physical condition, sensor means 24 activates inflating means 23 which then causes the inflation and deployment of inflatable sealing means 20 from non-deployed position 21 to deployed position 22. In deployed position 22, inflatable sealing means 20 forms a seal in flow bore 14 to prevent the passage of media 13 past the point where flow bore 14 is sealed by inflatable sealing means 20.

In the preferred embodiment of the method of the present invention, sensor means 24 automatically activates inflating means 23 upon detection of the physical condition or change in physical condition which may be a pre-selected physical condition or change in physical condition such as fluid pressure. Inflating means 23 is preferably any device which produces gas 26 in sufficient volume to inflate and deploy inflatable sealing means 20. Inflatable sealing means 20 is preferably in the form of air bag 36 when no object 39 is positioned in flow bore 14. Inflatable sealing ring 37 in the form of donut-shaped air bag 40 is preferably used when object 39 is positioned in flow bore 14.

Inflatable sealing assembly 10 may be used in pipelines such as water pipelines, gas pipelines, sewage pipelines, or the like. Inflatable sealing assembly 10 may be used in chemical plants, power plants, or nuclear plants. Inflatable sealing assembly 10 may also be used in oil and gas applications such as in the upstream market (drilling and completion of wells) and in the downstream market (hydrocarbon transportation and distribution).

As shown in FIGS. 3–8, inflatable sealing assembly 10 may be used as a blowout preventer. In this application, inflatable sealing assembly 10 is integrated with well casing 52. Well casing 52 is positioned downhole as shown for example in FIG. 3, which reveals the placement of well casing 52 in association with cement 54 and well formation 53. Sensor means 24 would be preset to detect and activate (preferably automatically) inflating means 23 upon detection of a pre-selected fluid pressure or a change in fluid pressure signifying that blowout conditions exist in flow bore 14.

Upon detection of the fluid pressure or change in fluid pressure, sensor means 24, as previously described herein, would activate inflating means 23 which in turn would cause the inflation and deployment of inflatable sealing ring 37 from non-deployed position 21 to deployed position 22. In deployed position 22, inflatable sealing ring 37 would form a seal between inner wall 16 of housing 11 and outer surface 38 of object 39 (object 39 being for example a work string).

It is preferred that inflatable sealing means 20 is able to be deflated when for example the physical conditions in flow bore 14 which necessitated sealing flow bore 14 have dissipated. Deflating devices (such as valves) may be incorporated into inflatable sealing means 20 to cause deflation when activated or external mechanisms may be employed to deflate inflatable sealing means 20, as for example by puncturing inflatable sealing means 20.

In the application where inflatable sealing assembly 10 is used as a blowout preventer, inflatable sealing ring 37 will preferably maintain deployment until such time that it is desired to deflate inflatable sealing ring 37. Deflation of inflatable sealing ring 37 may occur in a number of ways. For example, inflatable sealing ring 37 may be physically ruptured by a tool that is passed down through flow bore 14 from the well surface or through object 39. Additionally, other mechanisms can be incorporated into inflatable sealing assembly 10 which may cause deflation of inflatable sealing ring 37. For example, a release valve may be included and operatively connected to inflatable sealing ring 37 which when activated will cause the release of gas 26 within inflatable sealing ring 37 and thereby deflate the same.

It is to be understood that two or more inflatable sealing assemblies 10 may be integrated with tubular 12 to provide a series of spaced-apart inflatable sealing assemblies 10 within tubular 12. The use of multiple inflatable sealing assemblies 10 may be done in order to provide a backup sealing mechanism in case of malfunction.

Inflatable sealing assembly 10 may also function to activate other moving mechanisms which provide sealing of flow bore 14 in tubular 12. For example, inflating means 23 and/or inflatable sealing means 20 may cause activation of other mechanical sealing mechanisms such as rams, flappers, or the like which assist in the sealing of flow bore 14. The shut-off valves in pipelines and mechanical blowout preventers which are presently in use as sealing mechanisms are slow; the inflatable sealing assembly 10 of the present invention seals flow bore 14 rapidly thus preventing leaking of media 13 or potential erosion of the mechanical sealing mechanism.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. An inflatable sealing assembly for a flow carrier, comprising:

a housing capable of being integrated with a flow carrier to permit an unobstructed flow of a media through an inside of said flow carrier, said housing including an outer wall, an inner wall, and an interior between said outer and inner walls, wherein when said housing is integrated with said flow carrier said inner wall of said housing defines part of said inside of said flow carrier;

a compartment in said interior of said housing, said compartment having an opening that provides access to said inside of said flow carrier;

an inflatable sealing means having a non-deployed position and a deployed position, wherein in said non-deployed position said inflatable sealing means is stored substantially within said compartment;

an inflating means capable of deploying said inflatable sealing means from said non-deployed position to said deployed position, said inflating means positioned in said interior of said housing and operatively connected to said inflatable sealing means; wherein when said inflatable sealing means is in said deployed position said inflatable sealing means is inflated and seals off said inside of said flow carrier; and a sensor means operatively connected to said inflating means, said sensor means capable of detecting a physical condition affecting said flow carrier and of activating said inflating means to inflate said inflatable sealing means upon detection of said physical condition.

2. The inflatable sealing assembly according to claim 1, wherein said sensor means is positioned at least in part within said interior of said housing.

3. The inflatable sealing assembly according to claim 2, wherein said sensor means automatically activates said inflating means upon detection of said physical condition.

4. The inflatable sealing assembly according to claim 1, wherein said flow carrier has an external surface and wherein said sensor means is capable of detecting a physical condition affecting said external surface of said flow carrier.

5. The inflatable sealing assembly according to claim 1, wherein said sensor means is capable of detecting a physical condition in said inside of said flow carrier.

6. The inflatable sealing assembly according to claim 4, wherein said sensor means is also capable of detecting a physical condition in said inside of said flow carrier.

7. The inflatable sealing assembly according to claim 3, wherein said physical condition is selected from the group consisting of pressure, velocity, temperature, vibration, noise, density, odor, color, chemical composition, and any combination thereof.

8. The inflatable sealing assembly according to claim 1, wherein said inflating means comprises a means for inflating and deploying said inflatable sealing means.

9. The inflatable sealing assembly according to claim 1, wherein said housing has a top section, a central section, and a bottom section, said central section having a width which is greater than a width of said top section and a width of said bottom section of said housing so that said inner wall is tapered from said central section to each of said top and bottom sections.

10. The inflatable sealing assembly according to claim 9, wherein at least a portion of said inner wall at said central section of said housing comprises a protective plate.

11. The inflatable sealing assembly according to claim 9, wherein said compartment is positioned in said bottom section of said housing.

12. The inflatable sealing assembly according to claim 1, wherein said inflatable sealing means comprises an air bag.

13. The inflatable sealing assembly according to claim 1, wherein when said inflatable sealing means is in said deployed position, said inflatable sealing means is capable of being disassociated from said housing and of moving in said inside of said flow carrier to an area in said flow carrier where said inflatable sealing means seals said inside of said flow carrier at said area.

14. An inflatable sealing assembly for a tubular flow bore, comprising:

a cylindrical housing capable of being integrated with a tubular to permit an unobstructed flow of a fluid through a flow bore in said tubular, said cylindrical housing including a top section, a central section, and a bottom section interconnected by an outer wall, an inner wall, and an interior, wherein when said cylindrical housing is integrated with said tubular said inner wall of said cylindrical housing defines part of said flow bore in said tubular;

a compartment in said interior of said housing extending substantially around a circumference of said cylindrical housing, said compartment having an opening that provides access to said flow bore of said tubular;

an inflatable sealing ring having a non-deployed position and a deployed position, wherein in said non-deployed position said inflatable sealing ring is stored substantially within said compartment;

an inflating means capable of deploying said inflatable sealing ring from said non-deployed position to said deployed position, said inflating means positioned in said interior of said cylindrical housing and operatively connected to said inflatable sealing ring; wherein when said inflatable sealing ring is in said deployed position said inflatable sealing ring is inflated and sealingly compresses against an outer surface of a longitudinally extending object positioned within said flow bore thereby sealing said flow bore in said tubular; and a sensor means operatively connected to said inflating means, said sensor means capable of detecting a change in a physical condition affecting said tubular and of activating said inflating means to inflate said inflatable sealing ring upon detection of said change in said physical condition.

15. The inflatable sealing assembly according to claim 14, wherein said sensor means is positioned at least in part in said interior of said cylindrical housing.

16. The inflatable sealing assembly according to claim 15, wherein said sensor means automatically activates said inflating means upon detection of said change in said physical condition.

17. The inflatable sealing assembly according to claim 14, wherein said tubular has an external surface and wherein said sensor means is capable of detecting a change in a physical condition affecting said external surface of said tubular.

18. The inflatable sealing assembly according to claim 14, wherein said sensor means is capable of detecting a change in a physical condition in said flow bore of said tubular.

19. The inflatable sealing assembly according to claim 17, wherein said sensor means is also capable of detecting a change in a physical condition in said flow bore of said tubular.

20. The inflatable sealing assembly according to claim 16, wherein said physical condition is selected from the group consisting of pressure, velocity, temperature, vibration, noise, density, odor, color, chemical composition, and any combination thereof.

21. The inflatable sealing assembly according to claim 14, wherein said central section of said cylindrical housing has a width which is greater than a width of said top section and a width of said bottom section of said cylindrical housing so that said inner wall is tapered from said central section to each of said top and bottom sections.

22. The inflatable sealing assembly according to claim 21, wherein at least a portion of said inner wall at said central section of said cylindrical housing comprises a protective plate.

23. The inflatable sealing assembly according to claim 14, wherein said compartment is positioned in said bottom section of said cylindrical housing.

24. The inflatable sealing assembly according to claim 23, wherein said compartment storing said inflatable sealing ring is positioned in said bottom section of said cylindrical housing.

25. The inflatable sealing assembly according to claim 14, wherein said inflating means comprises a means for inflating and deploying said inflatable sealing ring.

26. The inflatable sealing assembly according to claim 14, wherein said inflatable sealing ring comprises a donut-shaped air bag.

27. The inflatable sealing assembly according to claim 14, wherein said tubular comprises at least a first tubular section and a second tubular section, said first and second tubular sections each having a top end and a bottom end and wherein said top section of said cylindrical housing is capable of being threadedly connected to said bottom end of said first tubular section and said bottom section of said cylindrical housing is capable of being threadedly connected to said top end of said second tubular section.

28. The inflatable sealing assembly according to claim 14, wherein said inner wall of said cylindrical housing covers said opening in said compartment when said inflatable sealing ring is in said non-deployed position.

29. The inflatable sealing assembly according to claim 28, wherein a section of said inner wall is capable of moving away from said opening in said compartment to permit deployment of said inflatable sealing ring.

30. The inflatable sealing assembly according to claim 28, wherein said inner wall comprises a first section and a second section, said first and second sections each having ends which are capable of being detachably connected together, wherein deployment of said inflatable sealing ring causes said ends of said first and second sections to detach.

31. The inflatable sealing assembly according to claim 14, further comprising a slidable wedge-shaped member positioned on said inner wall of said cylindrical housing and having a first end and a second end, said second end of said slidable wedge-shaped member covers said opening in said compartment when said inflatable sealing ring is in said non-deployed position.

32. The inflatable sealing assembly according to claim 31, wherein when said inflatable sealing ring is in said deployed position, said second end of said slidable wedge-shaped member is positioned away from said opening in said compartment with said first end of said slidable wedge-shaped member being wedged against said outer surface of said object.

33. A method of sealing off an inside of a flow carrier, comprising the steps of:

(a) providing an inflatable sealing assembly;

said inflatable sealing assembly comprising a housing capable of being integrated with said flow carrier to permit an unobstructed flow of a media through said inside of said flow carrier, said housing including an outer wall, an inner wall, and an interior between said outer and inner walls, wherein when said housing is integrated with said flow carrier said inner wall of said housing defines part of said inside of said flow carrier;

a compartment in said interior of said housing, said compartment having an opening that provides access to said inside of said flow carrier;

an inflatable sealing means having a non-deployed position and a deployed position, wherein in said non-deployed position said inflatable sealing means is stored substantially within said compartment;

an inflating means capable of deploying said inflatable sealing means from said non-deployed position to said deployed position, said inflating means positioned in said interior of said housing and operatively connected to said inflatable sealing means; wherein when said inflatable sealing means is in said deployed position said inflatable sealing means is inflated and seals off said inside of said flow carrier; and a sensor means operatively connected to said inflating means, said sensor means capable of detecting a physical condition affecting said flow carrier and of activating said inflating means to inflate said inflatable sealing means upon detection of said physical condition;

(b) integrating said inflatable sealing assembly with said flow carrier;

(c) allowing said sensor means to detect a physical condition affecting said flow carrier.

34. The method of sealing off an inside of a flow carrier according to claim 33, further comprising the step of:

(d) causing said sensor means to activate said inflating means upon detection of said physical condition, wherein said inflating means inflates and deploys said inflatable sealing means from said non-deployed position to said deployed position to seal off said inside of said flow carrier.

35. The method of sealing off an inside of a flow carrier according to claim 34, further comprising the step of:

(e) causing said inflated and deployed inflatable sealing means to deflate.

36. The method of sealing off an inside of a flow carrier according to claim 33, wherein said sensor means detects a physical condition affecting an external surface of said flow carrier.

37. The method of sealing off an inside of a flow carrier according to claim 33, wherein said sensor means detects a physical condition in said inside of said flow carrier.

38. The method of sealing off an inside of a flow carrier according to claim 36, wherein said sensor means also detects a physical condition in said inside of said flow carrier.

39. The method of sealing off an inside of a flow carrier according to claim 34, wherein said inflatable sealing means is disassociated from said housing and moves in said inside of said flow carrier to an area in said flow carrier where said inflatable sealing means seals said inside of said flow carrier at said area.

40. The method of sealing off an inside of a flow carrier according to claim 33, further comprising the steps of:

(a1) providing at least a second inflatable sealing assembly;

said second inflatable sealing assembly comprising a housing capable of being integrated with said flow carrier to permit an unobstructed flow of a media through said inside of said flow carrier, said housing including an outer wall, an inner wall, and an interior between said outer and inner walls, wherein when said housing is integrated with said flow carrier said inner wall of said housing defines part of said inside of said flow carrier;

a compartment in said interior of said housing, said compartment having an opening that provides access to said inside of said flow carrier;

an inflatable sealing means having a non-deployed position and a deployed position, wherein in said non-deployed position said inflatable sealing means is stored substantially within said compartment;

an inflating means capable of deploying said inflatable sealing means from said non-deployed position to said deployed position, said inflating means positioned in said interior of said housing and operatively connected to said inflatable sealing means; wherein when said inflatable sealing means is in said deployed position said inflatable sealing means is inflated and seals off said inside of said flow carrier; and a sensor means operatively connected to said inflating means, said sensor means capable of detecting a physical condition affecting said flow carrier and of activating said inflating means to inflate said inflatable sealing means upon detection of said physical condition;

(b2) integrating said second inflatable sealing assembly with said flow carrier;

(c2) allowing said sensor means in said second inflatable sealing assembly to detect a physical condition affecting said flow carrier.

41. The method of sealing off an inside of a flow carrier according to claim 40, further comprising the step of:

(d1) causing said sensor means in said second inflatable sealing assembly to activate said inflating means in said second inflatable sealing assembly upon detection of said physical condition, wherein said inflating means in said second inflatable sealing assembly inflates and deploys said inflatable sealing means in said second inflatable sealing assembly from said non-deployed position to said deployed position to seal off said inside of said flow carrier.

42. The method of sealing off an inside of a flow carrier according to claim 41, further comprising the step of:

(e1) causing said inflated and deployed inflatable sealing means in said second inflatable sealing assembly to deflate.

43. A method of sealing a flow bore in a tubular wherein said tubular comprises at least a first tubular section and a second tubular section, said first and second tubular sections each having a top end and a bottom end, comprising the steps of:

(a) providing an inflatable sealing assembly;

said inflatable sealing assembly comprising a housing capable of being integrated with said tubular to permit an unobstructed flow of a fluid through said flow bore in said tubular, said housing including a top section, a central section, and a bottom section interconnected by an outer wall, an inner wall, and an interior;

a compartment in said interior of said housing, said compartment having an opening that provides access to said flow bore in said tubular;

an inflatable sealing means having a non-deployed position and a deployed position, wherein in said non-deployed position said inflatable sealing means is stored substantially within said compartment;

an inflating means capable of deploying said inflatable sealing means from said non-deployed position to said deployed position, said inflating means positioned in said interior of said housing and operatively connected to said inflatable sealing means; wherein when said inflatable sealing means is in said deployed position said inflatable sealing means is inflated and seals said flow bore in said tubular; and a sensor means operatively connected to said inflating means, said sensor means capable of detecting a change in a physical condition affecting said tubular and of activating said inflating means to inflate said inflatable sealing means upon detection of said change in said physical condition;

(b) connecting said top section of said housing to said bottom end of said first tubular section of said tubular and connecting said bottom section of said housing to said top end of said second tubular section of said tubular so that said inner wall of said housing defines part of said flow bore in said tubular;

(c) allowing said sensor means to detect said change in said physical condition affecting said tubular.

44. The method of sealing a flow bore in a tubular according to claim 43, wherein said inflatable sealing assembly is integrated with said tubular by attaching said inflatable sealing assembly to an inside surface of said tubular.

45. The method of sealing a flow bore in a tubular according to claim 44, wherein said inflatable sealing assembly is attached to said inside surface of said tubular by fixation means.

46. The method of sealing a flow bore in a tubular according to claim 43, further comprising the step of:

(d) causing said sensor means to activate said inflating means upon detection of said change in said physical condition, wherein said inflating means inflates and deploys said inflatable sealing means from said non-deployed position to said deployed position to seal said flow bore in said tubular.

47. The method of sealing a flow bore in a tubular according to claim 46, wherein said sensor means automatically activates said inflating means upon detection of said change in said physical condition.

48. The method of sealing a flow bore in a tubular according to claim 47, wherein said physical condition is selected from the group consisting of pressure, velocity, temperature, vibration, noise, density, odor, color, chemical composition, and any combination thereof.

49. The method of sealing a flow bore in a tubular according to claim 43, wherein said inflating means comprises a means for inflating and deploying said inflatable sealing means.

50. The method of sealing a flow bore in a tubular according to claim 43, wherein said inflatable sealing means is an air bag.

51. The method of sealing a flow bore in a tubular according to claim 46, wherein said activation of said inflating means also causes activation of at least one mechanical moving means.

52. A method of sealing a flow bore in a tubular wherein said tubular comprises at least a first tubular section and a second tubular section, said first and second tubular sections each having a top end and a bottom end and wherein a longitudinally extending object is positioned in said flow bore of said tubular, comprising the steps of:

(a) providing an inflatable sealing assembly;

said inflatable sealing assembly comprising a cylindrical housing capable of being integrated with said tubular to permit an unobstructed flow of a fluid through said flow bore in said tubular, said cylindrical housing including a top section, a central section, and a bottom section interconnected by an outer wall, an inner wall, and an interior;

a compartment in said interior of said cylindrical housing extending substantially around a circumference of said cylindrical housing, said compartment having an opening that provides access to said flow bore in said tubular;

an inflatable sealing ring having a non-deployed position and a deployed position, wherein in said non-deployed position said inflatable sealing ring is stored substantially within said compartment;

an inflating means capable of deploying said inflatable sealing ring from said non-deployed position to said deployed position, said inflating means positioned in said interior of said cylindrical housing and operatively connected to said inflatable sealing ring; wherein when said inflatable sealing ring is in said deployed position said inflatable sealing ring is inflated and sealingly compresses against an outer surface of said longitudinally extending object positioned within said flow bore thereby sealing said flow bore in said tubular; and a sensor means operatively connected to said inflating means, said sensor means capable of detecting a change in a physical condition affecting said tubular and of activating said inflating means to inflate said inflatable sealing ring upon detection of said change in said physical condition;

(b) connecting said top section of said cylindrical housing to said bottom end of said first tubular section of said tubular and connecting said bottom section of said cylindrical housing to said top end of said second tubular section of said tubular so that said inner wall of said cylindrical housing defines part of said flow bore in said tubular;

(c) allowing said sensor means to detect said change in said physical condition affecting said tublar.

53. The method of sealing a flow bore in a tubular according to claim 52, further comprising the step of:

(d) causing said sensor means to activate said inflating means upon detection of said change in said physical condition, wherein said inflating means inflates and deploys said inflatable sealing ring from said non-deployed position to said deployed position to seal said flow bore in said tubular.

54. The method of sealing a flow bore in a tubular according to claim 53, wherein said sensor means automatically activates said inflating means upon detection of said change in said physical condition.

55. The method of sealing a flow bore in a tubular according to claim 54, wherein said physical condition is selected from the group consisting of pressure, velocity, temperature, vibration, noise, density, odor, color, chemical composition, and any combination thereof.

56. The method of sealing a flow bore in a tubular according to claim 52, wherein said inflating means comprises a means for inflating and deploying said inflatable sealing ring.

57. The method of sealing a flow bore in a tubular according to claim 52, wherein said inflatable sealing ring is a donut-shaped air bag.

* * * * *